US007828169B2

(12) United States Patent
Robinson et al.

(10) Patent No.: US 7,828,169 B2
(45) Date of Patent: Nov. 9, 2010

(54) MERCHANDISER

(75) Inventors: Michael J. Robinson, Delran, NJ (US); William P. Manteufel, Cinnaminson, NJ (US)

(73) Assignee: Menasha Corporation, Neenah, WI (US)

( * ) Notice: Subject to any disclaimer, the term of this patent is extended or adjusted under 35 U.S.C. 154(b) by 503 days.

(21) Appl. No.: 11/767,271

(22) Filed: Jun. 22, 2007

(65) Prior Publication Data

US 2008/0067102 A1 Mar. 20, 2008

Related U.S. Application Data

(60) Provisional application No. 60/815,690, filed on Jun. 22, 2006.

(51) Int. Cl.
*B65D 1/36* (2006.01)

(52) U.S. Cl. ..... 220/525; 206/468; 220/345.1; 312/260

(58) Field of Classification Search ..... 206/459.5, 206/468, 581, 730–734, 740, 742, 756, 758, 206/774; 211/133.1, 135, 153; 220/345.1, 220/505, 525, 526, 557, 812; 229/122, 125.12; 312/139.2, 242, 245, 260, 306, 312, 349
See application file for complete search history.

(56) References Cited

U.S. PATENT DOCUMENTS

| | | | | | |
|---|---|---|---|---|---|
| 4,375,874 | A * | 3/1983 | Leotta et al. | ..... | 242/560 |
| 4,793,664 | A * | 12/1988 | Jackson | ..... | 312/306 |
| 4,826,265 | A * | 5/1989 | Hockenberry | ..... | 312/326 |
| 5,706,953 | A * | 1/1998 | Polvere | ..... | 206/736 |
| 5,711,423 | A * | 1/1998 | Fuller, Jr. | ..... | 206/246 |
| 2003/0042828 | A1 * | 3/2003 | Bonin | ..... | 312/245 |
| 2006/0283775 | A1 * | 12/2006 | Mark | ..... | 206/781 |

* cited by examiner

*Primary Examiner*—Luan K Bui
(74) *Attorney, Agent, or Firm*—Ungaretti & Harris LLP

(57) ABSTRACT

A merchandiser (10) is disclosed having a main body (20), top shelf (110) and bottom shelf (31). A slidable graphics panel (90) with a bumper (100) formed in the back thereof is positioned such that the interlocking channels (60,61) permit the graphics panel (90) to move between upper and lower positions relative to the main body (20). When the graphics panel (90) is in the upper position, the wares (200) on the bottom shelf (31) are viewable to potential purchasers and when the graphics panel (90) is in the lower position, the wares (200) on the upper shelf are viewable to potential purchasers. A sample opening (80) is also constructed in the body (20) wherein a product sample (200) may be conveniently removed, tested or demonstrated and returned to the merchandiser (10).

6 Claims, 8 Drawing Sheets

MERCHANDISER

CROSS-REFERENCE TO RELATED APPLICATIONS

This application claims priority to currently U.S. Provisional Patent Application No. 60/815,690 filed Jun. 22, 2006, which is hereby incorporated by reference as if fully set forth herein.

TECHNICAL FIELD

The present invention relates to a container or merchandiser that both supports product and advertising. The advertising includes a movable front graphics panel covering or exposing product firmly supported and displayed on either a top shelf or a bottom shelf.

BACKGROUND OF THE INVENTION

Merchandisers have become very popular as retailers try to attract customers to products. The merchandisers come in all sizes and colors. Typical merchandisers support product thereon or therein and are free standing or supported on or to conventional shelving. Customized merchandisers are frequently very attractive and sized for specific product. As a result, because product can be stored, shipped and displayed in them, they simplify the distributor's or manufacturer's shipping and the retailers' storing, unloading and displaying of product. Significantly, they also appeal to consumers as they look nice and display goods in a customized and appealing manner.

Regrettably, there is a trade-off with respect to standard merchandisers, that being advertising or graphics on the one hand and, on the other hand, product support. Specifically, the more graphics used on the front of the display, the fewer products that can be displayed, and the more products displayed in the display, the less graphics that can be used. If a display has a front panel with advertisement thereon, product generally cannot be displayed behind the panel. Typically, product is displayed above and below the front advertising panel on internal shelves or hooks. Accordingly, there is a need for a more versatile display maximizing the graphics or advertising on the front thereof and the amount of product displayed therein or thereon.

SUMMARY OF THE INVENTION

The present development is an improvement upon existing display systems or merchandisers. In the preferred embodiment, three blanks are constructed to form three components of the merchandiser, namely the main body, the movable/slidable graphics panel, and the top shelf. The top shelf is attached to the main body and supports and displays goods thereon. A bottom shelf is constructed in the main body to likewise support and display goods. Channels attached to the front of the main body and to the back of the graphics panel interlock with one another permitting the graphics panel to move between upper and lower positions. In the upper position, the wares supported on the bottom shelf are viewable to customers and potential purchasers; and in the lower position, the wares supported on the upper shelf are viewable to customers and potential purchasers.

The blank of the main body is further constructed to include a sample opening wherein a product sample may be conveniently removed, tested or demonstrated, and returned to the main body. For example, if the items to be housed by the merchandiser are a brand of hand lotion, a sample lotion container may be placed in the sample opening for potential purchasers to access, test and replace. Additionally, a brochure carrier may be attached to the merchandiser adjacent the goods being displayed and the sliding graphics panel.

Keeping this in mind, a first aspect of the present invention is directed to a merchandiser for displaying items. The merchandiser comprises a main body enclosure and a graphics panel. The main body enclosure has a front surface and defines a first cavity separated from a second cavity by a partition. The cavities are recessed to hold items for display. The graphics panel is slideably attached to the main body enclosure and is used to selectively cover one of the first and second cavities while revealing the other of the first and second cavities.

Further to this aspect of the invention, the main body may have a first pair of channels attached to the main body on opposing sides of at least one of the first and second cavities. The graphics panel is slideable within the first pair of channels to selectively cover one of the first and second cavities. The graphics panel may have a second pair of channels attached thereto. The second pair of channels traverse within the first pair of channels to selectively cover one of the first and second cavities.

The graphics panel of this aspect may further have an exposed surface for displaying information and an opposing back surface. The back surface includes a member or rear bumper extending outwardly therefrom and located within one of the first and second cavities and adjacent to the partition separating the first and second cavities.

The merchandiser may still further comprise a first display condition wherein the first cavity is at least substantially fully covered by the graphics panel and a second display condition wherein the first and second cavities are at least partially covered by the graphics panel. Here, the member projecting outwardly from the opposing surface of the graphics panel is adjacent the partition in the first display condition and spaced a distance from the partition in the second display condition. The second display condition is created as the graphics panel slides downwardly covering at least a portion of the first cavity and the second cavity. The graphics panel may slide downwardly automatically as items are removed from the second cavity. Accordingly, the member projecting outwardly from the back surface and along a bottom edge of the graphics panel engages items within the second cavity to retain the graphics panel in one of the first display or second display conditions. After a predetermined number of items are removed from the second cavity, the graphics panel slides downwardly to reveal the contents of the first cavity.

The merchandiser of this aspect may further comprise a third display condition wherein the second cavity is at least substantially fully covered by the graphics panel and the first cavity is at least substantially fully exposed. The second cavity may have a surface opposite the partition separating the first and second cavities. The member projecting outwardly from the opposing surface of the graphics panel engages the surface opposite the partition in the third display condition to retain the merchandiser in the third display condition. In the third display condition, the graphics panel has slid downwardly substantially fully covering the second cavity with the first cavity substantially uncovered.

A second aspect of the invention is directed to a display packaging. The display packaging comprises a main body enclosure, a graphics panel and first and second pairs of C-shaped channels.

The main body enclosure is constructed from a single folded blank of a paper product. The main body enclosure has opposing top and bottom surfaces separated by opposing front and back surfaces, separated by opposing left and right surfaces and defining a first cavity located above a second cavity. Each cavity is recessed in the main body portion. The cavities are separated by a partition constructed from a single folded blank of a paper product.

The graphics panel is constructed from a single folded blank of a paper product and slideably attached to the main body enclosure to selectively cover one of the first and second cavities while revealing the contents of another of the first and second cavities. The graphics panel includes a top surface for displaying product information and a back surface with a rear bumper extending outwardly therefrom into one of the first and second cavities and adjacent the partition separating the first and second cavities.

The first pair of C-shaped channels are attached to a surface of the main body on opposing sides of at least one of the first and second cavities. The second pair of C-shaped channels are attached to a surface of the graphics panel, each channel of the second pair of C-shaped channels traversing within a corresponding channel of the first pair of C-shaped channels.

This aspect of the invention may further include first, second and third display conditions. The first display condition occurs when the graphics panel at least substantially fully covers the first cavity while the second cavity is at least substantially uncovered. The second display condition occurs when the graphics panel has slid downwardly covering at least a portion of the first cavity and the second cavity. The third display condition occurs when the graphics panel has slid downwardly substantially covering the second cavity and the first cavity is substantially uncovered. In this aspect, the rear bumper engages items within the second cavity to retain the graphics panel in one of the first display or second display conditions, and the graphics panel slides downwardly when a predetermined number of items are removed from the second cavity.

Another aspect of the present invention is directed to a display packaging for selectively displaying a plurality of items. The display packaging comprises a main body, a partition, and a graphics panel.

The main body has opposing top and bottom surfaces separated by opposing front and back surfaces which are separated by opposing left and right surfaces. The main body defines an upper cavity aligned with a lower cavity. Each cavity is recessed in the main body. The upper cavity has a plurality of upper cavity items housed therein, and the lower cavity has a plurality of lower cavity items housed therein.

The partition separates the upper cavity from the lower cavities. At least one of the plurality of upper cavity items is supported in the upper cavity by the partition.

The graphics panel is slideably attached to the main body to selectively cover one of the upper and lower cavities while revealing another of the upper and lower cavities. The graphics panel has a top surface for displaying product information and a back surface. The back surface has a rear bumper extending outwardly therefrom into the lower cavity and supported by an uppermost item of the plurality of lower cavity items.

This packaging further comprises a starting and an ending display condition. The starting display condition occurs when the graphics panel at least substantially fully covers the upper cavity while the lower cavity is at least substantially uncovered. The ending display condition occurs when graphics panel has slid downwardly at least substantially fully covering the lower cavity and the upper cavity is at least substantially uncovered. The ending display condition is also created automatically as a predetermined number of lower cavity items is removed from the lower cavity.

The packaging may include an intermediate display condition. The intermediate display condition occurs when the graphics panel has slid downwardly covering at least a portion of the upper cavity and at least a portion of the lower cavity. The intermediate display condition is created automatically as a first predetermined number of lower cavity items, less than the predetermined number of items required to cause the ending display condition, is removed from the lower cavity.

Other advantages and aspects of the present invention will become apparent upon reading the following description of the drawings and the detailed description of the invention.

BRIEF DESCRIPTION OF THE DRAWINGS

To understand the present invention, it will now be described by way of example, with reference to the accompanying drawings in which.

DETAILED DESCRIPTION OF THE INVENTION

Figure 1:
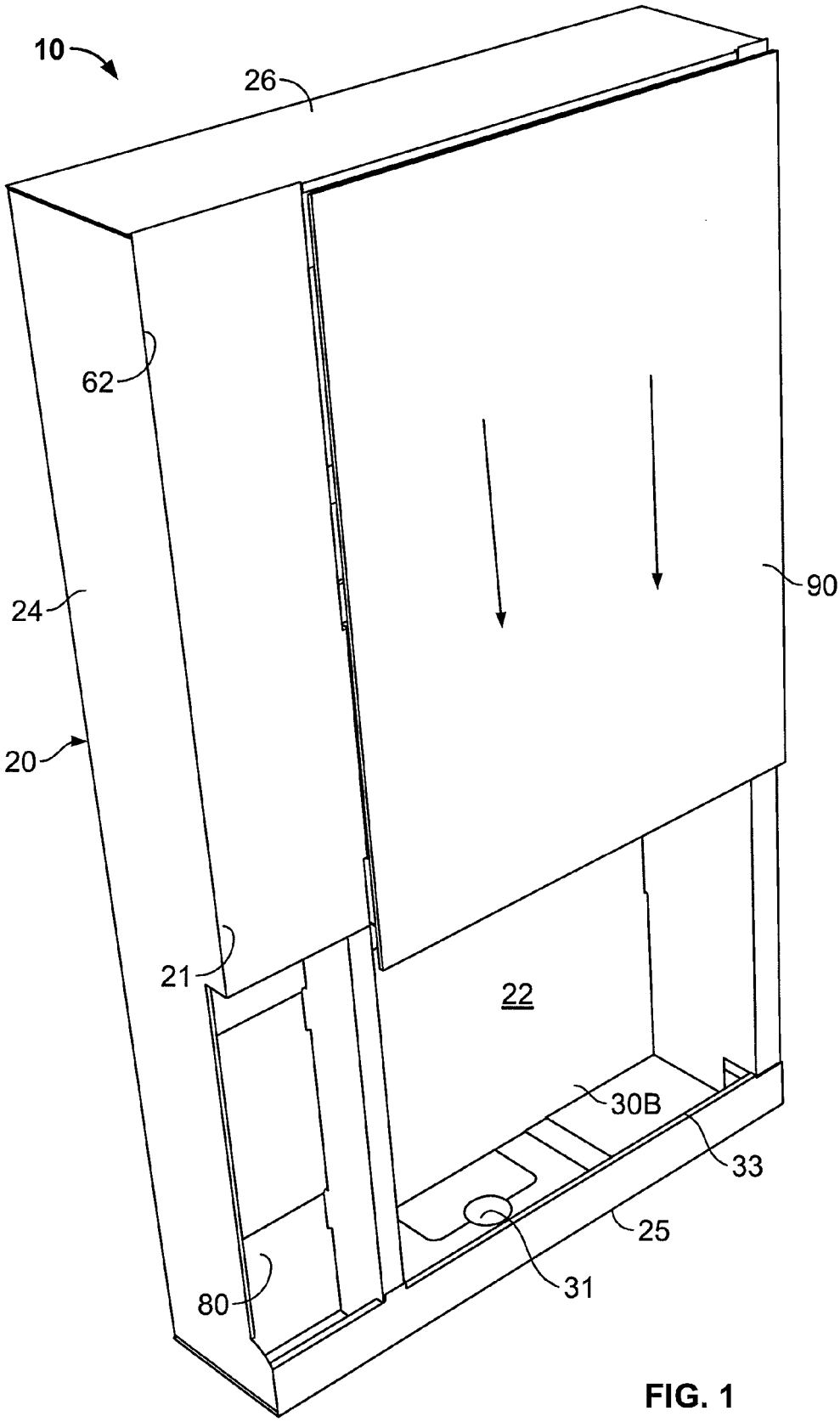
FIG. 1 is a front perspective representation of the merchandiser with the front panel in its upper position or first display condition.

While this invention is susceptible of embodiments in many different forms, there is shown in the drawings and will herein be described in detail, preferred embodiments of the invention with the understanding the present disclosure is to be considered as an exemplification of the principles of the invention and is not intended to limit the broad aspect of the invention to the embodiments illustrated. The present invention has the following main components and techniques for forming, constructing and using the assembly.

FIGS. 1-2 and 6-10 show the merchandiser 10 of the present invention. It includes three main components a body 20, a graphics panel 90 and a top shelf 110. Each blank (FIGS. 3-5) used for forming the merchandiser 10 includes cut lines (solid black lines) and fold lines (broken lines). Preferably, the fold lines are scored or weakened by well-known techniques to facilitate folding and assembly. The blank for the main body 20 can be folded so as to form a front surface 21, back surface 22, right side surface 23, left side surface 24, bottom surface 25 and top surface 26. Tabs X are created in the blank, along with slots Y. Flaps W are also created to reinforce the constructed structure. When assembled, a product cavity 30 (30A being the top cavity and 30B being the lower cavity) is formed in the front of the merchandiser. In addition, a bottom shelf or bottom supporting surface 31 is formed. The blank for the top shelf 110 is folded and attached via tabs and slots, or by adhesives, to the back 22 surface of the assembly 10 so as to form a top supporting surface 111.

The body 20 is an enclosure having opposing top and bottom surfaces 26,25 separated by the opposing front and back surfaces 21,22, which are separated by the opposing right and left surfaces 23,24. The main body enclosure 20 defines the upper cavity 30A and lower cavities 30B. The upper cavity 30A is aligned with the lower cavity 30B. Each cavity 30A,30B is recessed within the main body enclosure 20. The top shelf 110 acts as a partition separating the upper and lower cavities 30A,30B. It should be noted that while the upper and lower cavities are shown as single cavities, they can each have partitions therein so as to support multiple cavities therein to further segregate and display items.

Figure 3:
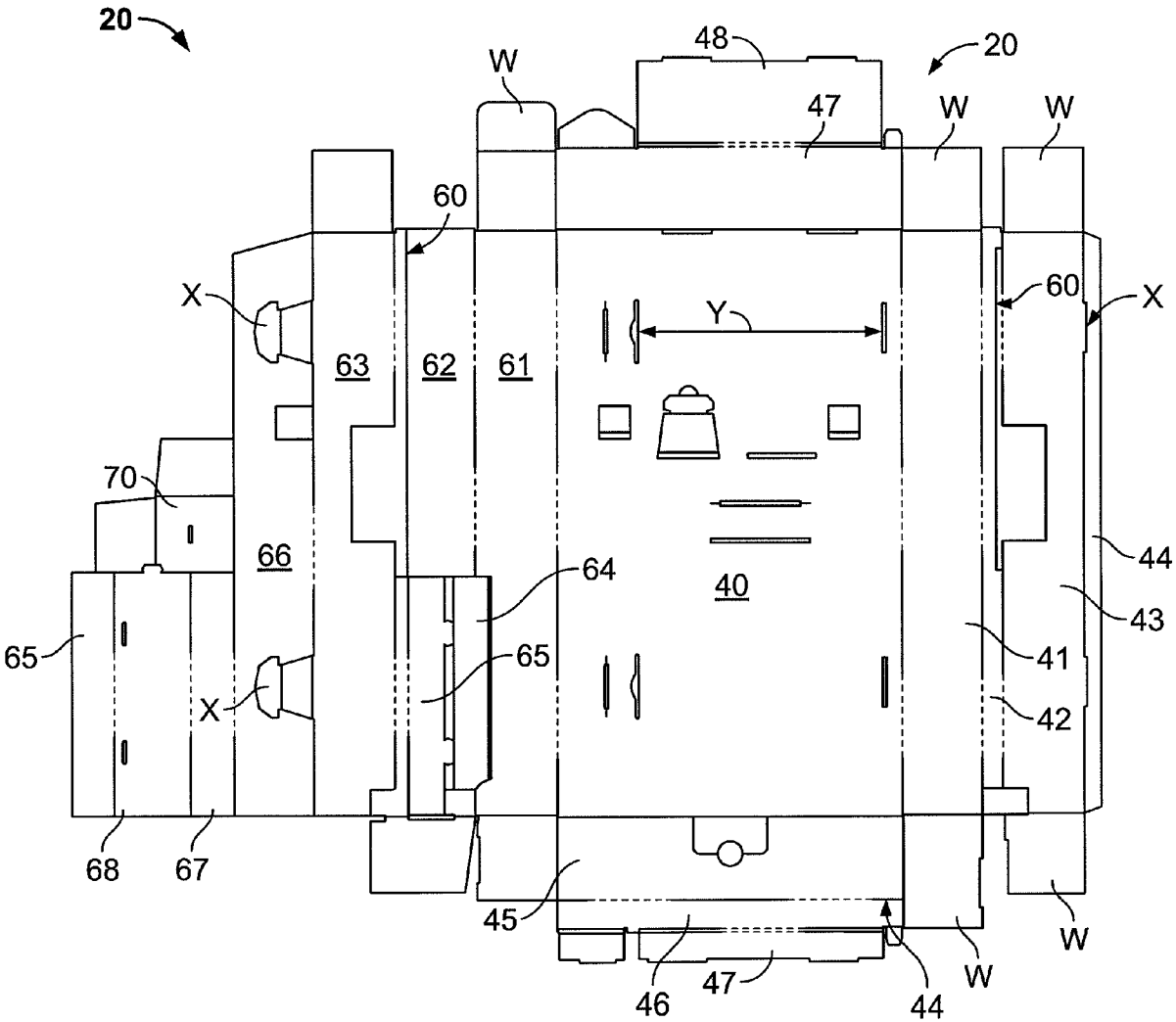
FIG. 3 is a top plan view of the blank used to make the body of the merchandiser showing scores, cuts and fold lines.

Turning to FIG. 3 and the blank for the body 20, the structure is generally formed around the back panel 40 which forms the back surface 22. The right side panels 41,42,43,44 are folded so as to form the right side 23 of the body 20. Leading panels 42,62 also support a C-channels 60 (solid line). The bottom panels 45,46,47 are folded to form the bottom surface 25 and bottom support surface 31 for the body 20. A bottom lip 33 is also formed in front of the bottom support surface 31 to contain the product (200A,200B) supported on the support surface 31 and prevent the product from inadvertently falling from the shelf. And, top panels 47,48 are folded to form the top surface 26 of the system 20. Finally, left side panels 61-70 are folded to form the left side 24 of the body 20, including the sample opening 80. Leading panel 62 also supports a C-channel 60.

The graphics panel 90 is slideably attached to the main body enclosure 20 to selectively cover one of the upper and lower cavities 30A,30B while revealing another of the upper and lower cavities 30A,30B. This will be described in more detail in conjunction with FIGS. 8-10. The graphics panel 90 has a top surface or front panel 91 for displaying product information and a back surface of the front panel 91 has a member or rear bumper 100 extending outwardly from the back surface into one of the cavities, preferably the lower cavity 30B.

Figure 4:
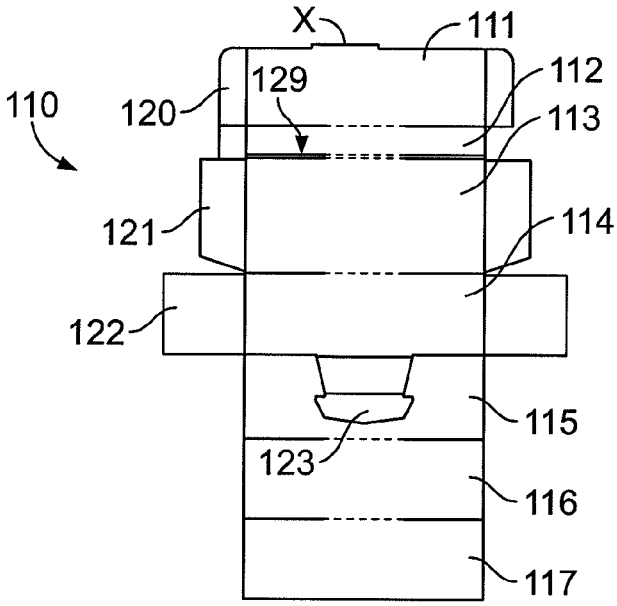
FIG. 4 is a top plan view of the blank used to make the top shelf or partition of the merchandiser showing scores, cuts and fold lines.
Figure 5:
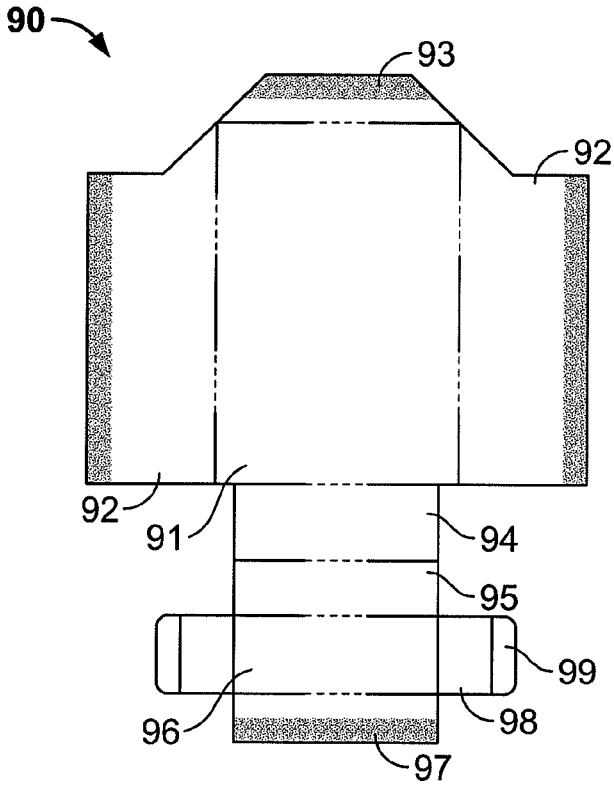
FIG. 5 is a is a top plan view of the blank used to make the graphics panel of the merchandiser showing scores, cuts and fold lines.

The graphics panel 90 is constructed separately from the main body enclosure 20. The blank is shown in FIG. 4 and the front in FIGS. 1 and 2 and the back in FIG. 6. The blank 90 specifically includes the front panel 91 with opposed side panels 92 and a top panel 93 folded and adhered to the front panel 91. Lower panels 94-99 are folded and adhered to the front panel 91 so as to form the rear bumper 100 (see FIG. 6). This bumper 100 acts as a stop for the graphics panel 90 as it is slid up and down relative to the main body enclosure 20 as will be described in more detail below. The graphics panel 90 has a length substantially less than a height of the main body enclosure 20.

The back side of the graphics panel 90, namely the side facing the body 20, also supports C-channels 61 (solid line).

Figure 6:
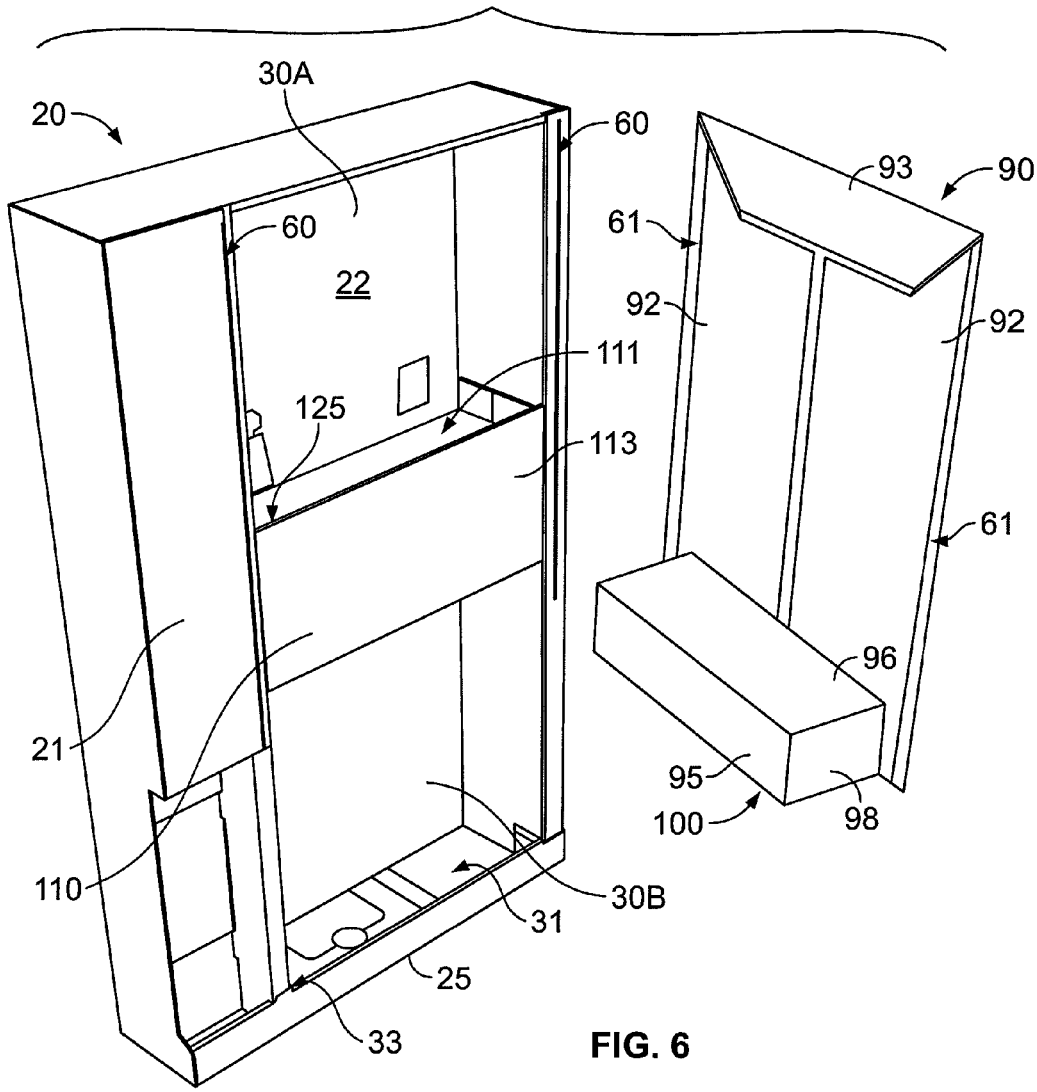
FIG. 6 is a further representation of the front of the base, with the graphics panel removed, and back of the graphics panel.
Figure 7:
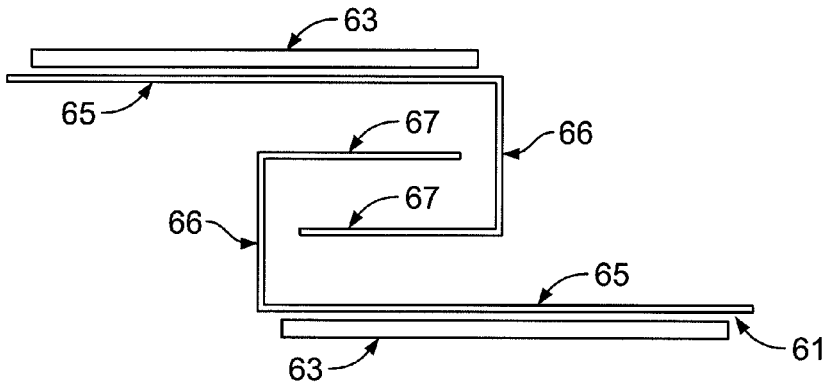
FIG. 7 is a detail of the C-channels secured to the base and graphics panel.

The graphics panel 90 is slideably attached to the main body enclosure using the first and second pairs of C-shaped channels 60,61. The positioning and construction of the C-channels 60,61 are shown in FIGS. 6 and 7. Each C-channel 60,61 takes the general shape of a "C" having a support member 65, extension 66 and interlocking flange 67. Each support member is adhered to the supporting surface 42,62,92 by adhesive or otherwise. As show in the figures, the preferred embodiment employs double-sided foam tape 63. The C-channels 60 attached to the body 20 are substantially vertical and parallel to one another; similarly, the C-channels 61 attached to the graphics panel 90 are substantially vertical and parallel to one another. The length and spacing between the C-channels are matched so that C-channels 60 of the body 20 can mate or couple with the C-channels 61 of the graphics panel 90.

Figure 2:
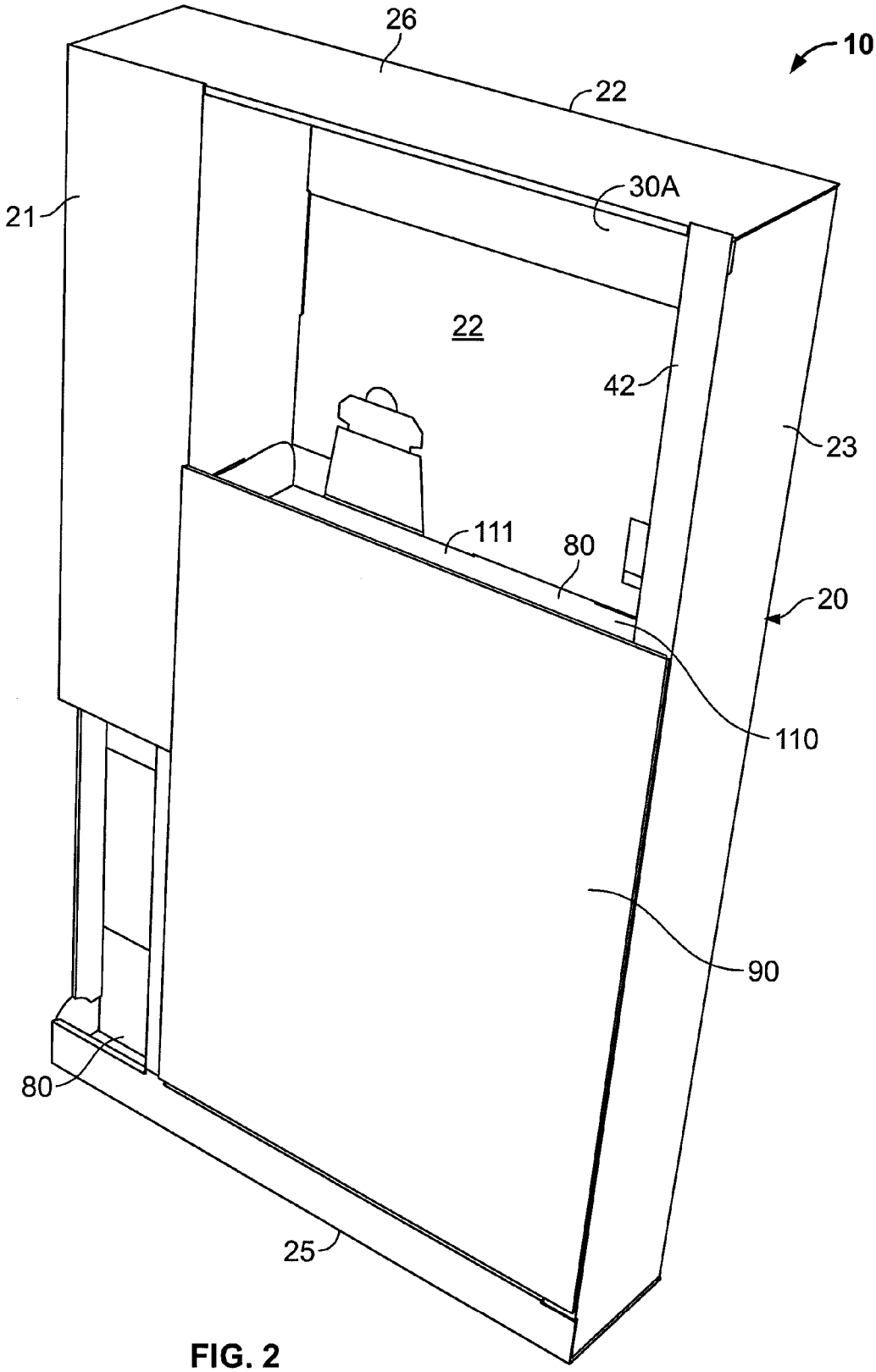
FIG. 2 is a front perspective representation of the merchandiser with the front panel in its lower position or third display condition.

As further shown in FIG. 7, the opposed C-channels 60,61 are associated with each other and communicate, or interconnect, with one another such that the flange 67 of each rides in the pocket formed between the flange 67 and support member 65 of the other. With C-channels interlocking, the graphics panel 90 is movable between an upper position (FIG. 1) and a lower position (FIG. 2). In the upper position, the bumper 100 formed on the back of the graphics panel 90 contacts the top shelf 110, and in the lower position, the bumper 100 contacts the lower support surface 31. The assembly's front graphics panel 90 is also capable of automatically moving. The top surface of the goods 200B on the bottom support surface 31 contact the bottom of the rear bumper 100 and hold it, as well as the graphics panel 90. When the goods are removed from the bottom support surface 31 and the assembly, the rear bumper 100 is no longer supported by the goods and the weight of the panel 90 permits it to slide down so that the bottom surface of the rear bumper 100 contacts the bottom support surface 31 thereby exposing the product 200A on the top shelf support surface 111.

The blank for the top shelf 110 is shown in FIG. 4 with the panels shown and fold lines shown in broken lines. The shelf 110 is folded to form a top supporting surface 111 and an upper lip 125 to permit the secure supporting of product thereon. It is further folded to form a strong base structure and to allow tabs X,123 to cooperate with slots in the back panel 40 of the base 20.

Figure 8:
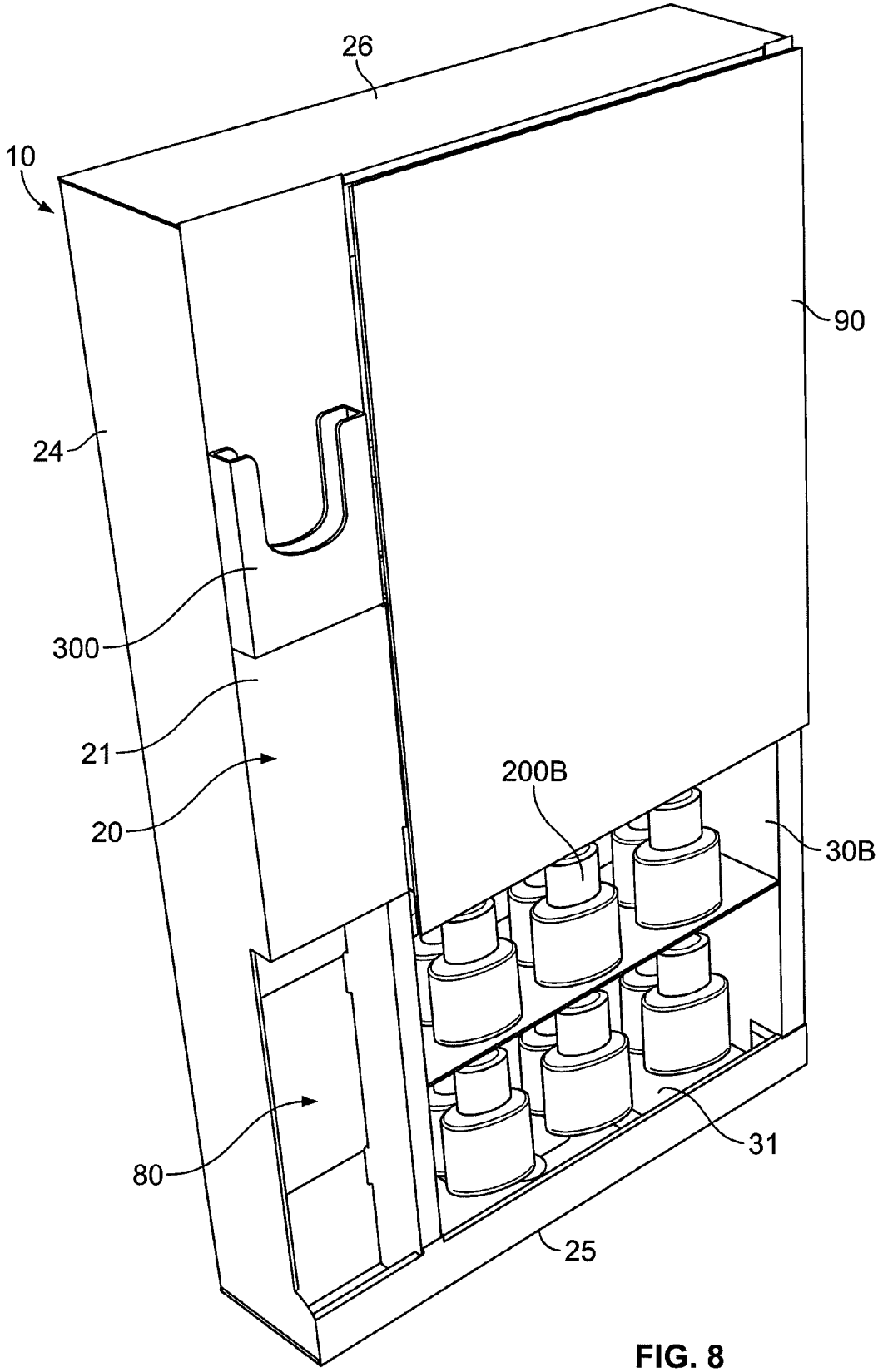
FIG. 8 is front perspective view of the merchandiser of the present invention with the front panel in its upper position or first display condition.
Figure 9:
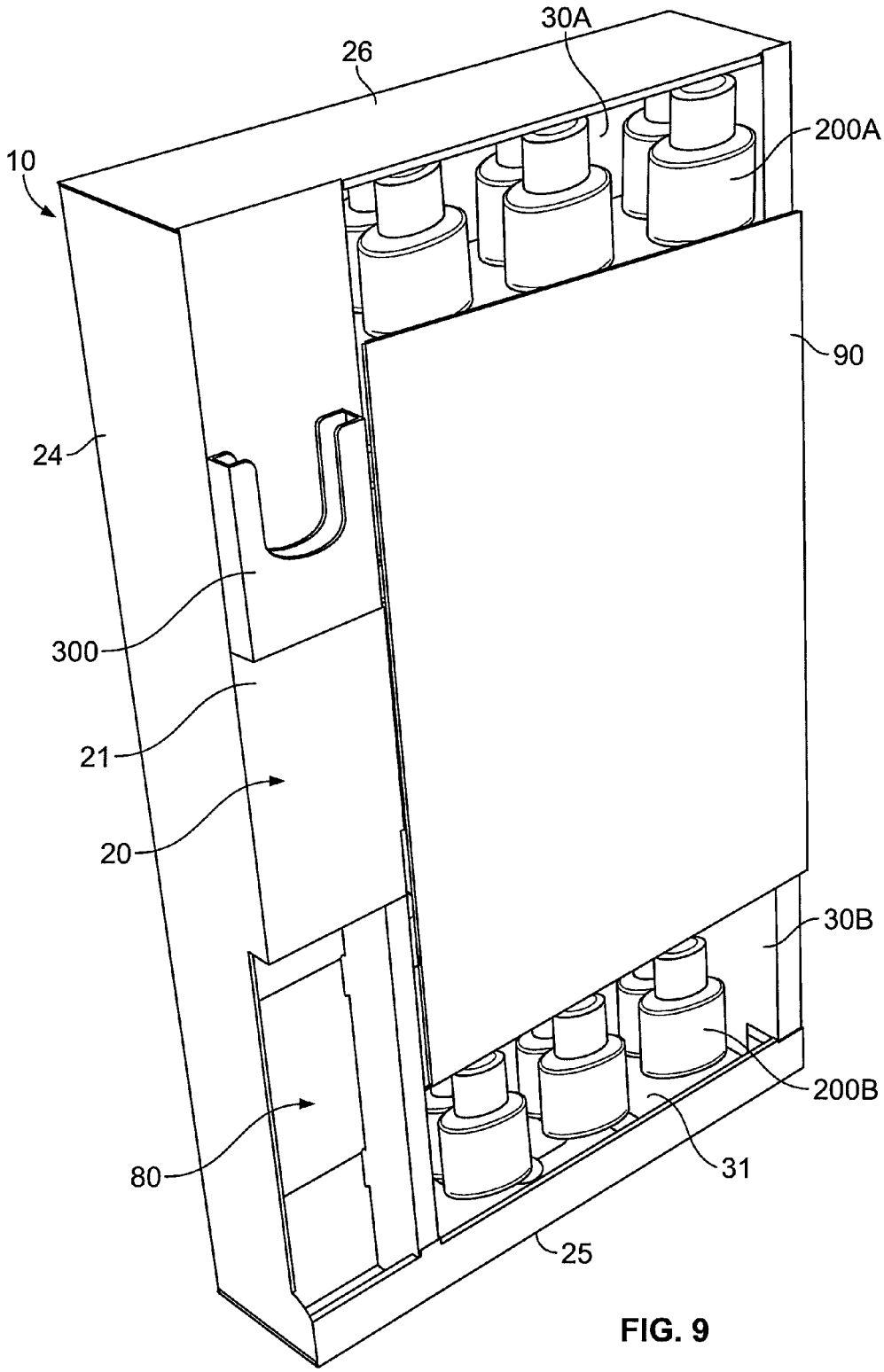
FIG. 9 is a front perspective view of the of the merchandiser of the present invention with the front panel in its intermediate or second display condition; and, FIG. 10 is a front perspective view of the of the merchandiser of the present invention with the front panel in its lower position or third display condition.
Figure 10:
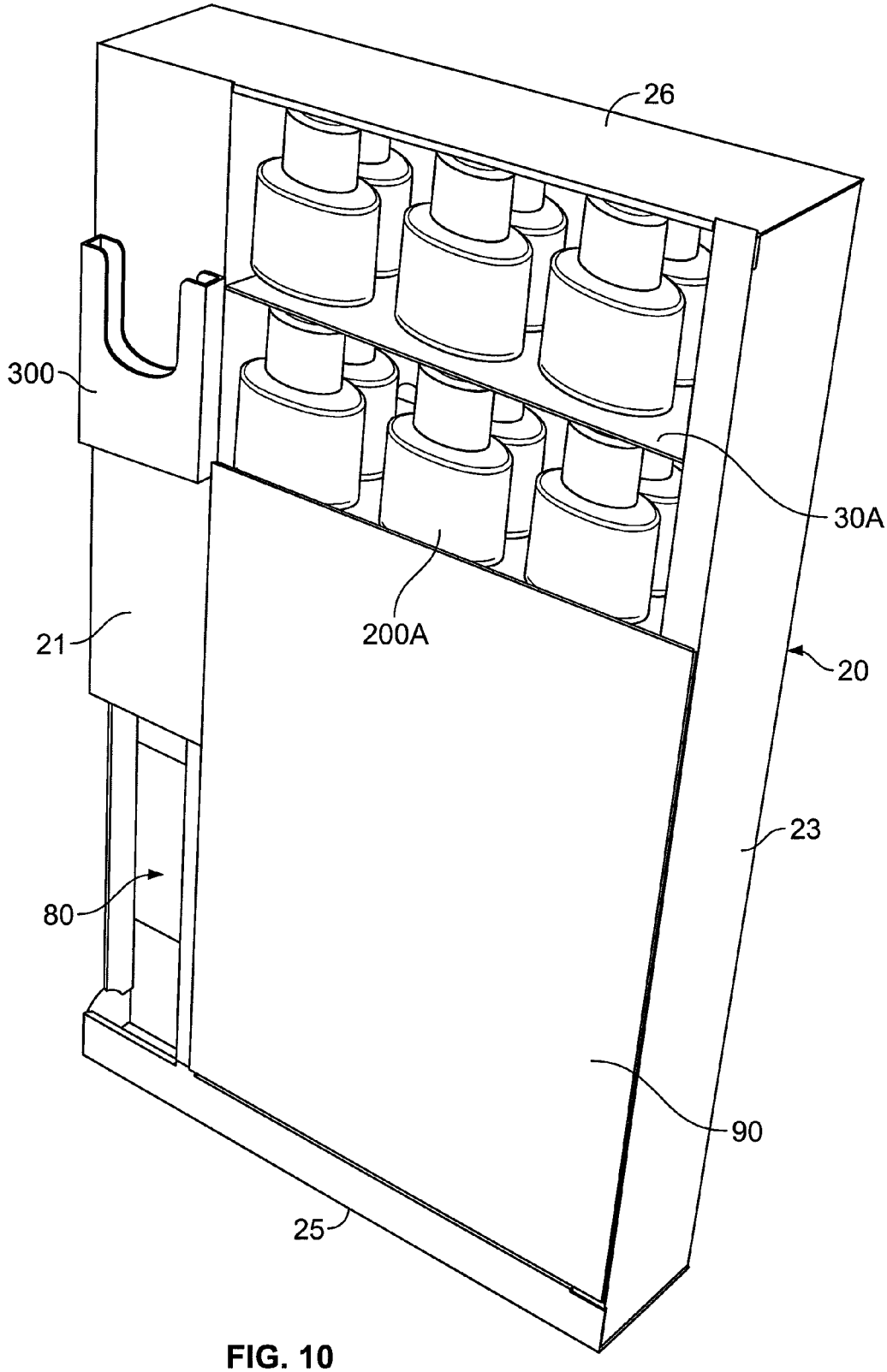

FIGS. 8-10 generally show the unit 10 with the wares or products 200A,200B stored thereon. Specifically, the upper cavity 30A houses a plurality of upper cavity items 200A for display, and the lower cavity 30B houses a plurality of lower cavity items 200B for display. The upper cavity items 200A are supported by the top shelf 110, preferably atop the supporting surface 111. The lower cavity items 200B are supported by the bottom support surface 31 within the lower cavity 30B opposite the top shelf 110. The rear bumper 100 is supported in the lower cavity 30B by at least one of the lower cavity items 200B.

FIGS. 8-10 illustrate a means for selectively displaying the upper cavity items 200A and the lower cavity items 200B. For example, FIG. 8 shows the graphics panel 90 in the upper position or starting display condition; FIG. 9 shows the graphics panel 90 in the center position or intermediate display condition; and FIG. 10 shows the graphics panel 90 in the lower position or ending display condition. In addition, a brochure holder 300 is shown and can be affixed to a front panel of the base 20.

As illustrated in FIG. 8, in the starting display condition, the graphics panel at least substantially fully covers the upper cavity 30A and the upper cavity items 200A. The lower cavity 30B is at least substantially uncovered so that the lower cavity items 200B are on display. The lower cavity items 200B are generally accessible while the upper cavity items 200A are concealed by the graphics panel 90 and are generally inaccessible. The rear bumper 100 is positioned within the lower cavity 30B and adjacent the partition or top shelf 110.

As illustrated in FIG. 9, in the intermediate display condition, the graphics panel 90 has slid downwardly covering at least a portion of the upper cavity 30A and at least a portion of the lower cavity 30B. This condition is created automatically as a first predetermined number of the lower cavity items 200B are removed from the lower cavity allowing the rear bumper 100 to descend within the lower cavity 30B to increase a distance, or cause a space, between the top shelf 110 and the rear bumper 100. Accordingly, the graphics panel 90 slides downwardly along the face of the merchandiser 10. In this position, items 200A,200B stored within the upper and lower cavity 30A,30B are simultaneously accessible and on display.

As illustrated in FIG. 10, in the ending display condition, the graphics panel 90 has slid downwardly at least substantially fully covering the lower cavity 30B and the upper cavity 30A is at least substantially uncovered. This condition is also created automatically as a second predetermined number of lower cavity items 200B are removed from the lower cavity 200B. This second predetermined number of lower cavity items 200B is generally a greater than the first predetermined number and preferably exhausts the supply of items available within the lower cavity 30B. Thus, no items remain in the lower cavity 30B on which to support the rear bumper 100, and the rear bumper 100 descends the length of the lower cavity 30B to rest or be supported upon the bottom support surface 31. The upper cavity 30A is then fully uncovered to display all of the remaining upper cavity items 200A.

It should be noted that the sample opening or cavity 80 remains uncovered regardless of the position of the graphics panel 90.

Additional tabs and slots on the back panel 40 permit one to secure the assembly 10 to wing rack displays (wire and other types) and other displays well known in the industry for displaying merchandise. Ties, hooks, mounts, wing clips, and other conventional fasteners may also be used to accomplish this. To mount to wing rack displays, the assembly 10 is can be sized so as to have a height of 24" and width of 14". Other sizes can also be constructed for other types of display. In addition, for free standing displays, a base can be constructed to support the assembly 10.

The terms "first," "second," "upper," "lower," "front," "back," "top," "bottom," etc. are used for illustrative purposes only and are not intended to limit the embodiments in any way. The term "plurality" as used herein is intended to indicate any number greater than one, either disjunctively or conjunctively as necessary, up to an infinite number. The terms "joined" and "connected" as used herein are intended to put or bring two elements together so as to form a unit, and any number of elements, devices, fasteners, etc. may be provided between the joined or connected elements unless otherwise specified by the use of the term "directly" and supported by the drawings.

While the specific embodiments have been illustrated and described, it is recognized that numerous modifications and variations can be made without significantly departing from the spirit of the invention, and the scope of protection is only limited by the scope of the accompanying Claims.

We claim:

1. A merchandiser comprising:

a main body enclosure having a front surface and a first cavity and a second cavity recessed therein;

a partition separating the first cavity from the second cavity;

a graphics panel slideably attached to the main body enclosure having a length substantially less than a height of the main body enclosure and selectively covering one of the first and second cavities while revealing the other of the first and second cavities;

a starting display condition wherein the graphics panel at least substantially covers the first cavity while the second cavity is at least substantially uncovered;

an ending display condition, wherein the graphics panel has slid downwardly at least substantially covering the second cavity and the first cavity is at least substantially uncovered, and wherein sliding movement of the graphics panel to at least partially cover the second cavity is actuated upon removal of items from the second cavity; and wherein the graphics panel has a front surface and an opposing back surface, a member projects outwardly from the back surface along a bottom edge of the graphics panel, the member for engaging items within the second cavity to retain the graphics panel in the starting display condition.

2. The merchandiser of claim 1 wherein the member projecting outwardly from the back surface of the graphics panel engages a lower support surface of the second cavity opposite the partition separating the first and second cavities to retain the merchandiser in the ending display condition.

3. A merchandiser comprising:

a main body enclosure having a front surface and a first cavity and a second cavity recessed therein;

a partition separating the first cavity from the second cavity;

a graphics panel slideably attached to the main body enclosure having a length substantially less than a height of the main body enclosure and selectively covering one of the first and second cavities while revealing the other of the first and second cavities, the graphics panel comprising an exposed front surface for displaying information and an opposing surface having a member projecting outwardly therefrom and into the second cavity;

a first display condition wherein the first cavity is substantially covered by the graphics panel;

a second display condition wherein the first and second cavities are at least partially covered by the graphics panel;

a third display condition wherein the second cavity is at least substantially covered by the graphics panel and the first cavity is exposed;

wherein the member projecting outwardly from the opposing surface of the graphics panel is adjacent the partition in the first display condition and spaced a distance from the partition in the second display condition; and wherein the second cavity has a surface opposite the partition, and the member projecting outwardly from the opposing surface of the graphics panel engages the surface opposite the partition in the third display condition to retain the merchandiser in the third display condition.

4. A display packaging comprising:

a main body enclosure constructed from a single folded blank of a paper product, the main body enclosure having opposing top and bottom surfaces separated by opposing front and back surfaces separated by opposing left and right surfaces and defining a first cavity located above a second cavity, each cavity recessed in the main body enclosure;

a partition separating the first and second cavities;

a graphics panel constructed from a single folded blank of a paper product and slideably attached to the main body enclosure to selectively cover one of the first and second cavities while revealing a contents of another of the first and second cavities, the graphics panel having a top surface for displaying product information and a back surface having a rear bumper extending outwardly from the back surface into one of the first and second cavities and adjacent the partition separating the first and second cavities;

a first pair of C-shaped channels attached to a surface of the main body on opposing sides of at least one of the first and second cavities; and, a second pair of C-shaped channels attached to a surface of the graphics panel, each channel of the second pair of C-shaped channels traversing within a corresponding channel of the first pair of C-shaped channels.

5. The display packaging of claim 4 further comprising:

a starting display condition wherein the graphics panel at least substantially fully covers the first cavity while the second cavity is at least substantially uncovered;

an ending display condition wherein the graphics panel has slid downwardly at least substantially fully covering the second cavity and the first cavity is at least substantially uncovered; and, wherein the rear bumper engages items within the second cavity to retain the graphics panel in the starting display condition, the graphics panel sliding downwardly to the ending display condition when a predetermined number of items are removed from the second cavity.

6. A display packaging for selectively displaying a plurality of items, the display packaging comprising:

a main body enclosure having opposing top and bottom surfaces separated by opposing front and back surfaces separated by opposing left and right surfaces and defining an upper cavity aligned with a lower cavity, each cavity recessed in the main body enclosure, the upper cavity having a plurality of upper cavity items housed therein, and the lower cavity having a plurality of lower cavity items housed therein;

a partition separating the upper and lower cavities, at least one of the plurality of upper cavity items supported in the upper cavity by the partition;

a graphics panel slideably attached to the main body enclosure to selectively cover one of the upper and lower cavities while revealing another of the upper and lower cavities, the graphics panel having a top surface for displaying product information and a back surface having a rear bumper extending outwardly from the back surface into the lower cavity and supported by an uppermost item of the plurality of lower cavity items;

a starting display condition wherein the graphics panel at least substantially fully covers the upper cavity while the lower cavity is at least substantially uncovered; and, an ending display condition wherein the graphics panel has slid downwardly at least substantially covering the lower cavity and the upper cavity is at least substantially uncovered, created automatically as a predetermined number of lower cavity items are removed from the lower cavity.

* * * * *